United States Patent [19]

Schultz

[11] 3,975,724

[45] Aug. 17, 1976

[54] ROOM STATUS SIGNALING SYSTEM

[76] Inventor: Bethel F. Schultz, 8553 Orion St., Sepulveda, Calif. 91343

[22] Filed: July 31, 1975

[21] Appl. No.: 600,846

[52] U.S. Cl. ..... 340/286; 340/301; 340/332

[51] Int. Cl.[2] ..... G08B 25/00

[58] Field of Search ..... 340/286, 332

[56] References Cited

UNITED STATES PATENTS

| | | | |
|---|---|---|---|
| 2,915,745 | 12/1959 | Sebestik | 340/286 |
| 3,694,810 | 9/1972 | Mullens | 340/286 |

*Primary Examiner*—Thomas B. Habecker
*Attorney, Agent, or Firm*—Roger A. Marrs

[57] ABSTRACT

A room status signaling system is disclosed herein employing a plurality of separate signaling circuits employing the internal telephone wiring so that a separate signaling circuit is provided for each room. The plurality of signaling circuits terminate at a central location or board having an indicator such as a lamp for displaying the status of a room. Each signaling circuit not only includes an indicator lamp in series, but further terminates at its opposite end to a switch located at the room. The switch includes a housing having a slot adapted to receive a coin and a chamber for holding the coin after it has been inserted into and through the slot. The chamber further includes a pair of fixed spaced apart contacts which are insulated from each other and which are mechanically and electrically connected together when the coin is held in the chamber of the holder. The signaling system further includes a coded key which is insertably received through the slot so as to project into the chamber to displace the coin from the chamber and break electrical and mechanical connection between the connectors. The presence of either the metallic coin or the insulated key completes or breaks electrical circuit in the signaling system so as to energize or de-energize the lamp or respective indicators at the central location.

10 Claims, 4 Drawing Figures

ROOM STATUS SIGNALING SYSTEM

BACKGROUND OF THE INVENTION

1. Field of the Invention

This invention relates to indicating systems, such as a system for indicating the presence or absence of a room occupant so as to indicate the availability or vacancy of rooms in hotels or the like and, more particularly, the present invention relates to a status signaling system in general and is applicable for indicating the status of a room of the kind used in hotels, clubs and the like to enable signals to be given from a plurality of separate rooms indicating the status or condition of the respective rooms.

2. Description of the Prior Art

At the present time, it is the general practice in such businesses as hotel and motel management to be notified when a patron is in occupancy of a particular room for hire. Particularly in large hotels, for example, it is generally necessary to notify different personnel concerning the status of rooms to be prepared for occupancy or in the process of preparation for occupancy. In a hotel, it is usual to provide at a front desk location, an array of indicator lamps which display information pertaining to the status of different rooms. Each of the lamps is connected in a signaling circuit associated with a respective room, and each signaling circuit may include indicator lamps at other locations such as at a housekeeper's panel and in a respective room. When a room is to be made up for occupancy, the desk clerk operates an appropriate switch at the desk panel and this conditions the respective room signaling circuit whereby a characteristic signal appears at the desired panel indicating the status of the room.

Although such a prior art system does provide indication of room status, it is noted that the operation of the switch is at the central location and is performed by the desk clerk. Also, it is apparent that there is no automatic indication that a patron has vacated his room even though his check-out time may be substantially later. Furthermore, in such prior art systems, there is no incentive for the patron to return the key to the desk clerk with the adverse effect that many keys are lost, stolen or otherwise disappear from use.

Furthermore, prior art systems do not lend themselves for duplexing of information such as may be incorporated into burglar alarm systems, emergency room call systems or patron related call systems. Numerous arrangements of this general kind have been proposed in the past such as is disclosed and shown in U.S. Pat. Nos. 1,623,950; 2,554,223 and 3,588,868. However, all such arrangements are very expensive to install because of the necessary extensive wiring involved and frequently on account of the elaborate equipment for providing the different characteristic signals in each of the signaling circuits. In general, several signaling circuits for each room are required, and each signaling circuit has required a number of call wires. Furthermore, none of these prior art systems include incentives for key return or for key collection when the room is intended to be vacated.

SUMMARY OF THE INVENTION

The above difficulties and problems encountered with conventional room status signaling systems are obviated by the present invention which provides a number of signaling circuits each associated with a respective room and wherein each signaling circuit includes an indicator display at a central unit such as the front desk in a hotel lobby. The opposite end of the signaling circuit includes a receptacle having a pair of contact closures normally in their opened condition. The contact closures are maintained opened by the insertion of a coded key into the receptacle. The receptacle further stores a metallic object such as a coin that effects closure between the contact closures when the key is not in its position. Insertion of the key forces the metallic object out of its closure relationship with the contacts and permits the metallic object to be withdrawn from the receptacle.

A feature of the invention resides in employing conventional telephone lines readily available in the hotel or motel for use in the signaling system so that minimum installation is required.

Therefore, it is among the primary objects of the present invention to provide a novel status signaling system in which each signaling circuit involves a minimum amount of wiring and yet is capable of handling a number of different status signals concerned with occupancy and condition of a selected room in a hotel or motel.

Another object of the present invention is to provide a novel room status signaling system having incentive means for room key return and room key collection at the room site.

Another object of the present invention is to provide a novel room signaling system incorporating a receptacle having contact closure normally opened when an installative key is introduced thereto and which insertion causes the expulsion of a monitary coin.

Another object of the present invention is to provide a novel room signaling system having a monitary incentive for key return and collection and which is coupled into a signaling system for indicating immediate room vacancy.

Yet another object of the present invention is to provide a novel system for indicating the presence or absence of patrons by visually indicating their presence at a central location and simultaneously and automatically incorporating provisions for accepting room key collection.

The features of the present invention which are believed to be novel are set forth with particularity in the appended claims. The present invention, both as to its organization and manner of operation, together with further objects and advantages thereof, may best be understood by reference to the following description, taken in connection with the accompanying drawings.

DESCRIPTION OF THE PREFERRED EMBODIMENT

Figure 1:
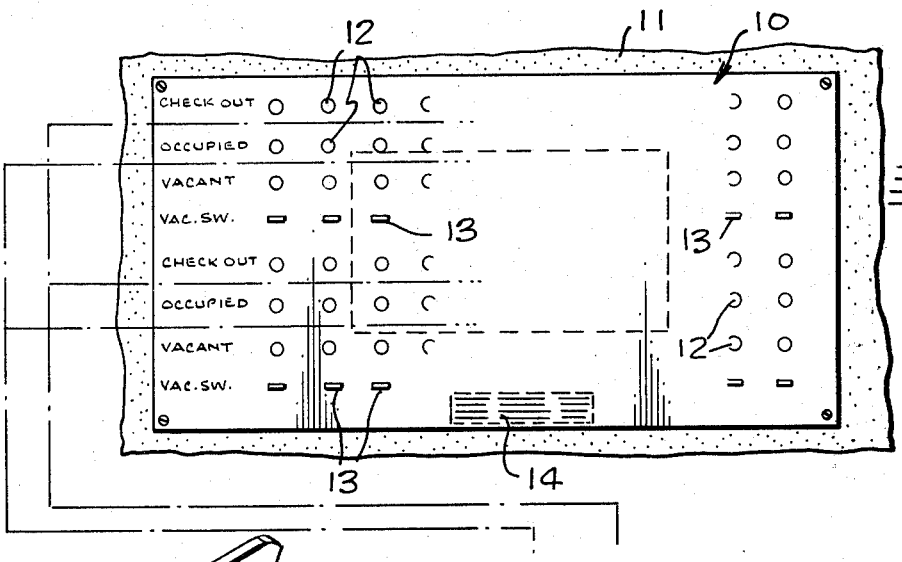
FIG. 1 is a schematic drawing of a panel incorporating indicating means at the central desk location serving as a terminous for the electrical signaling system of the present invention.

Although the present invention will be described with respect to an embodiment concerning hotels and motels and detail with respect to room rental and the vacancy or occupancy of rooms, it is to be understood that the novel signaling system of the present invention may be incorporated for other uses regarding other rental services such as lockers, over night parking for recreational vehicle parks, garages and the like. Referring now in detail to FIG. 1, a central display panel 10 is mounted on a suitable wall 11 at a desired location such as the central office desk in the lobby of a motel or hotel. The panel 10 is provided with a plurality of indicating means such as lamps as indicated by numeral 12. Additionally, it is to be noted that the plurality of lamps 12 are arranged in suitable rows and columns and that desired indicia or nomenclature is associated with each row of lights indicating the function or display intended. The columns of lights pertaining to various and separate rooms located throughout the hotel or motel. For example, column 1 as indicated by the first column of lights may be room 1 on the first floor. Column two may be room 2 on the first floor and so forth. The first row of lights when lit may indicate check-out while rows 2 and 3 may represent occupied and vacate, respectively, when lit.

Also, on the control panel 10, there is provided a plurality of manually operated switches 13 associated with each individual room. These switches may be operated by the desk clerk to clear the panel for that particular room. For example, when the room is vacant, the vacant light will be on and when the room is rented, the clerk can manually operate the vacant switch 13 to so indicate that the room is now occupied. This particular light will be described in greater detail further with respect to the signaling system and its operation from a remote location. Furthermore, the control panel 10 may be provided with a speaker means 14 so that various intercommunication and audible tones may be incorporated into the overall system.

Figure 2:
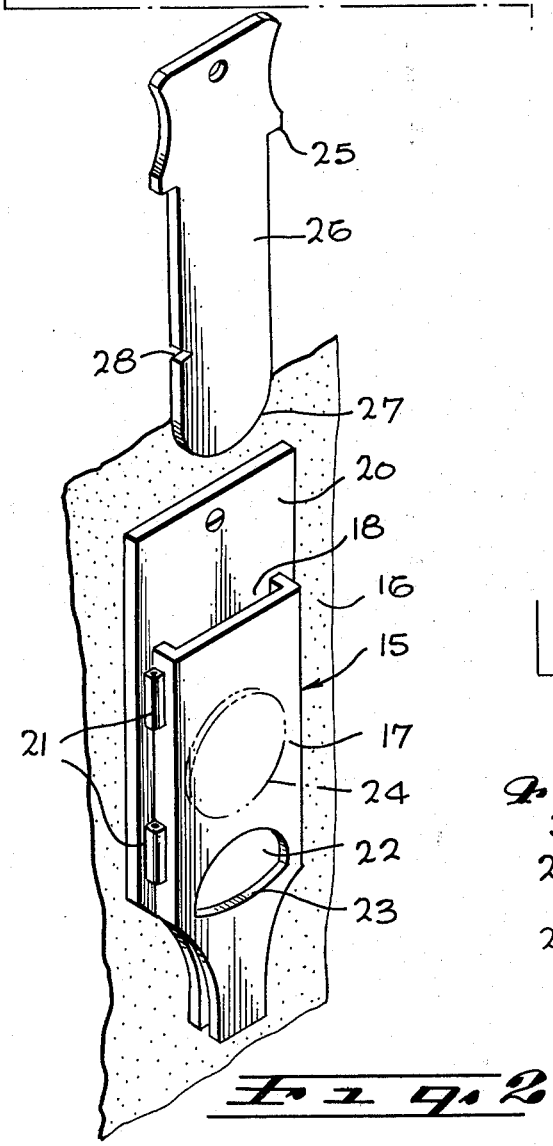
FIG. 2 is a perspective view of a terminal located in a separate room at the other end of the status signaling system of the present invention and illustrating a coded key in the position preparatory for insertion into the receptacle.

Referring now to FIG. 2, a receptacle 15 is shown mounted on a wall 16 adjacent the door in a room remote to the clerk and central display represented by panel 10. The receptacle 15 includes an enclosure 17 having a slotted opening 18 leading into an interior cavity thereof. The enclosure 17 is preferrably hinged mounted on a backboard 20 by means of a locking hinge arrangement of conventional design and style. For purposes of simplicity, the lock hinge is indicated collectively by numeral 21, and the enclosure or door 17 may be pivoted about the hinges when unlocked so as to expose and reveal the interior of the cavity defined by the opposing surfaces of backboard 20 and the rear side of enclosure 17. The enclosure 17 further includes a semi-circular opening 22 having a slightly outwardly projecting lip 23 integrally formed thereon. Consequently, one end of the enclosure 17 includes a slotted opening 18 at one end and a semi-circular opening 22 terminating in lip 23 at its other end. Therebetween lies a coin receiver within the enclosed chamber for temporarily holding a coin or other metallic object of a suitable monitary or denominational value. Such a coin representing a half-dollar or quarter is indicated in broken lines by numeral 24 and it is sufficient that the coin 24 be held within the confines of the receptacle by means of an interference fit with the opposing edges and wall surfaces defining the cavity. Coin 24 is introduced into the cavity by being inserted through the slotted opening 18. The coin 24 is dislodged or forcibly urged from the cavity by the introduction of a tab 25 having an elongated portion 26 adapted to be inserted through the slotted opening 18 into the coin cavity. The end of portion 26 is preferrably rounded as indicated by numeral 27 and this rounded end engages the periphery of coin 24 so as to urge the coin into the semi-circular opening 22.

It is to be understood that the tab 25 is attached to a standard key intended to operate the locking mechanism securing the door of the room. It is not the purpose nor the intent of the present invention to employ the tab 25 as the key for locking or unlocking the standard security lock of the room. It is the common and customary practice in commercial hotels and motels to include a tab with the room key so that should the key be lost, the key may be returned by using the name and address imprinted on the tab. Tab 25 is intended to constitute a tab of this variety with the novel exception that the tab includes an elongated shank or portion intended to be inserted into the receptacle 15. The shank 26 includes a locking means which may be a shaped notch 28 adapted to be engaged with a ratchet tooth, such as shown by numeral 30 in FIG. 3, whereby the tab 25 cannot be removed from the receptacle without unlocking the hinge enclosure 17 and rotating the same. Therefore, it can be seen that the patron or room occupant may place the tab 25 into the slotted opening of the receptacle when he is checking out or desires to vacate the room. The incentive for his inserting tab 25 into the receptacle is his foreknowledge that a coin 24 will then be dispensed for his usage. Therefore, the receptacle 15 serves as a collecting station for the room key and the incentive for gaining cooperation of the patron is dispensement of a coin for his use. At a later time, hotel management or service personnel can enter the room, unlock the enclosure or door 17 and free tab 25 from the locking tooth 30 so that another coin can be placed into the apparatus and the key tab removed.

Figure 4:
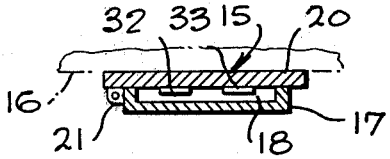
FIG. 4 is a transverse cross-sectional view of the receptacle as taken in the direction of arrows 4—4 of FIG. 3.
Figure 3:
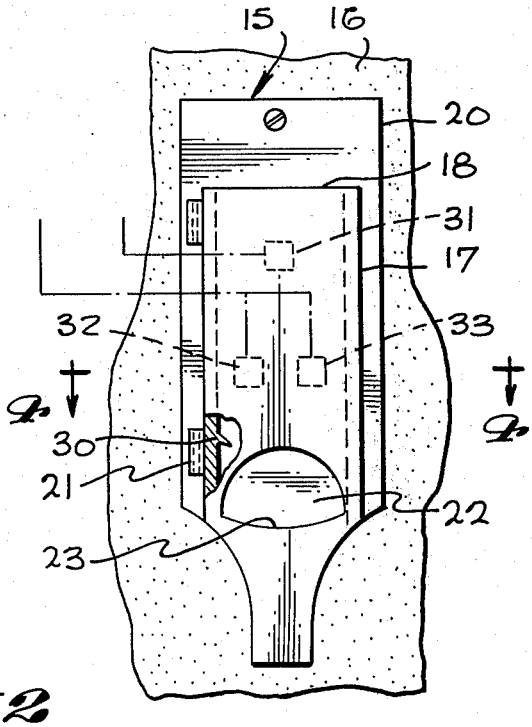
FIG. 3 is a front elevational view partially broken away, of the receptacle shown in FIG. 2.

Referring now to FIGS. 3 and 4, it can be seen that contact closures in the signaling system for a respective room are carried on the receptacle 15. A contact closure 31 may be activated and employed for energizing the light associated with the room for check-out. A pair of contact closures 32 and 33 are energized when the metallic device such as coin 24 interconnects between the two so that the light associated with occupied on the panel 10 is lit. Obviously, when the tab portion 26 of tab 25 is inserted through the slotted opening 18, switch contact 31 may be activated to indicate check-out while dislodgement of the coin from its location connecting contact closure 32 and 33 will cause the occupied light to turn off.

Therefore, it can be seen that the desk clerk has complete knowledge of room status throughout the entire hotel. In a typical installation, the console or panel 10 is located in the office and contains the three lights and a control switch for each room circuit. A patron or customer enters the hotel, approaches the desk and rents a room. At this time, a deposit may be obtained by the clerk for the key and the desk clerk explains to the guest that the key deposit is returned when he checks out by placing the key tab 25 in the key receptacle 15 that is in his room near the door. The clerk now touches the push button switch on the office console to indicate that the vacant light is turned off and the occupied light is turned on.

When the guest or patron is ready to check out, the key tab 25 is inserted through the slotted opening in the key receptacle along or close to the door in the room. At this immediate time, the coin 24 is released into the semi-circular opening and the customer takes his money and departs. However, it is to be noted that the key tab is locked in the receptacle. The moment the money is returned or released from the receptacle, a light is lit over the door on the outside of the room and a signal is sent to the office console. This signal effects the ring of the chime, turns off the occupied light and turns on the check out light.

The room is now ready for maintenance and re-rental. The maid or other service personnel may enter the room with a pass key and the key receptacle is unlocked. This now shuts off the master switch in the receptacle and all signals to the office console are terminated. The complete circuit is now de-energized and the door or enclosure 17 is unlocked. When the room is ready for re-rental, deposit money is placed into the receptacle and the door 17 is locked. When the deposit is placed in the receptacle and the door locked, the master switch is engaged on the receptacle and a signal is sent to the office console activating the vacant light and the check out light is now turned off.

When the deposit money is placed in the receptacle the entire system is re-energized and available for operation.

It is further understood that other systems may be incorporated into the signaling system of the present invention such as means for determining if equipment such as televisions or the like are taken or removed from the particular room. Also, other burglar and emergency alarm systems may be operably connected to the present system for dual usage.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A room status signaling system comprising:

a display panel having a plurality of attention seeking devices;

a coin receptacle mounted in said room remote from said display panel;

an occupancy electrical circuit interconnecting said receptacle with said display panel operable to selectively energize said attention seeking devices to indicate presence of a coin therein;

a vacancy electrical circuit interconnecting said display panel with said receptacle operable to selectively energize said attention seeking devices to indicate the non-presence of a coin therein; and means insertably received into said receptacle for dislodging the coin therefrom and for breaking said occupancy electrical circuit.

2. The invention as defined in claim 1 wherein said insertable means includes an elongated tab and latch means cooperatively carried between said tab and said receptacle to hold said tab in said receptacle.

3. The invention as defined in claim 2 including means carried on said receptacle for unlatching said latch means to remove said tab.

4. The invention as defined in claim 3 wherein said latch means includes a notch provided in the edge of said tab and a projection carried on said receptacle.

5. The invention as defined in claim 4 wherein said unlatching means includes a pivotally mounted door movably carried on a panel defined by a coin and tab receiving slot therebetween.

6. The invention as defined in claim 5 including a switch carried on said panel projecting into said receptacle slot and coupled into said vacancy circuit.

7. The invention as defined in claim 6 including a pair of contact arranged in spaced-apart relationship on said panel and coupled into said occupancy circuit;

said contacts being connected together by the coin to energize said occupancy circuit.

8. The invention as defined in claim 7 wherein said receptacle slot is open-ended to receive the coin at one end and expell the coin at the other end under forcible urging of said tab.

9. The invention as defined in claim 8 wherein said attention seeking devices are a combination of lights selectively operated by said vacancy and occupancy circuits responsive to presence and non-presence of the coin.

10. The invention as defined in claim 9 including limit means for arresting insertion of said tab into said receptacle slot.

* * * * *